US007780053B2

(12) United States Patent
Wen

(10) Patent No.: US 7,780,053 B2
(45) Date of Patent: Aug. 24, 2010

(54) NAIL GUN WITH AIR INJECTION MECHANISM

(75) Inventor: Wan-Fu Wen, Taipei Hsien (TW)

(73) Assignee: De Poan Pneumatic Corp., Taipei (TW)

( * ) Notice: Subject to any disclaimer, the term of this patent is extended or adjusted under 35 U.S.C. 154(b) by 0 days.

(21) Appl. No.: 11/537,576

(22) Filed: Sep. 29, 2006

(65) Prior Publication Data

US 2008/0087704 A1 Apr. 17, 2008

(51) Int. Cl.
*B25C 1/04* (2006.01)

(52) U.S. Cl. ..... 227/130; 239/526; 239/296; 239/569; 227/156

(58) Field of Classification Search ..... 239/296, 239/291, 525, 526, 569; 227/10, 130, 156
See application file for complete search history.

(56) References Cited

U.S. PATENT DOCUMENTS

| | | | | |
|---|---|---|---|---|
| 4,384,668 | A * | 5/1983 | Tutomu et al. | 227/8 |
| 6,783,050 | B2 * | 8/2004 | Ishizawa et al. | 227/130 |
| 2004/0026477 | A1 * | 2/2004 | Ishizawa et al. | 227/130 |
| 2005/0072275 | A1 * | 4/2005 | Sasak et al. | 81/57.44 |
| 2005/0211745 | A1 * | 9/2005 | Ishizawa et al. | 227/120 |
| 2006/0006207 | A1 * | 1/2006 | Akiba et al. | 227/10 |
| 2006/0144889 | A1 * | 7/2006 | Nishikawa et al. | 227/8 |
| 2006/0151565 | A1 * | 7/2006 | Nishikawa et al. | 227/10 |
| 2007/0059186 | A1 * | 3/2007 | Weaver et al. | 417/234 |
| 2007/0210132 | A1 * | 9/2007 | Akiba | 227/10 |
| 2007/0227477 | A1 * | 10/2007 | Akiba et al. | 123/46 SC |
| 2007/0290021 | A1 * | 12/2007 | Komazaki | 227/130 |

FOREIGN PATENT DOCUMENTS

| | | |
|---|---|---|
| JP | 2004-1136 | 1/2004 |

* cited by examiner

*Primary Examiner*—Len Tran
*Assistant Examiner*—Trevor E McGraw
(74) *Attorney, Agent, or Firm*—Chun-Ming Shih

(57) ABSTRACT

An air injection mechanism for nail guns includes a gun body having an air chamber; a valve base having a rod hole disposed in the gun body; a movable valve rod, one end of the valve rod engages with the rod hole and extends out of the gun body to form a press end, and another end of the valve rod extends through the air chamber and fixes to another side surface of the gun body, the valve rod and the rod hole cooperate to form an air guiding gap therebetween, the valve rod includes a ringed pushing surface; an air guiding passage formed in the valve rod, which includes an air inlet port connecting to the air guiding gap and an air injection port connecting to environment; an O-ring disposed in the rod hold for controlling the flux of the air that discharged form the air injection port.

5 Claims, 7 Drawing Sheets

NAIL GUN WITH AIR INJECTION MECHANISM

BACKGROUND

The present invention relates to a nail gun having an air injection mechanism, and particularly to a pneumatic nail gun having a valve rod disposed in a compressed air chamber thereof Pneumatic nail gun generally utilizes a compressed high pressure air in an air chamber thereof to drive a piston to beat a nail, for join two objects by shooting a nail through both objects, which are widely used in woodworking.

During the process of nailing up the objects by the pneumatic nail gun, a mass of dusts and wood chips are liable to be generated and distribute all over the objects, then, the positions of the objects to be nailed are covered by the dusts and wood chips. Therefore, a high pressure air gun is employed to blow off the dusts and wood chips. However, the operator has to take a high pressure air gun when he or she nail up objects by the pneumatic nail gun, which unduly increase the burden and make the operation inconveniently.

Laid open Japanese Patent No. 2004-001136 disclosed an improved nail gun having an air injection mechanism to overcome the problems above-described, which includes an air injection valve disposed besides an air chamber of a gun body of the nail gun. The air injection valve is connected to a nozzle via an air injection passage, and is connected with the air chamber via an air guiding passage. Moreover, a redactor is disposed at one of the air injection passage and the air guiding passage so as to reduce the pressure of the compressed air in the air injection passage or the air guiding passage via adjusting the redactor. The compressed air are injected out from the nozzle via pressing the air injection valve to guide the compressed air from the air guiding passage to the air injection passage.

However, the nail gun includes an air injection passage, an air guiding passage, and a redactor disposed at one of the air injection passage and the air guiding passage. These passages and the redactor make the configuration of the nail gun unduly complicated, and make the cost of the nail gun unduly high. Furthermore, the redactor may only reduce certain pressure of the compressed air, which may not enable the operator to freely control the pressure and flux of the air injected from the nozzle.

Accordingly, what is needed is a pneumatic nail gun that can overcome the above-described deficiencies.

BRIEF SUMMARY

An air injection mechanism is disposed in a pneumatic nail gun, which includes an air injection valve rod disposed in an air chamber of a gun body. The valve rod is integrated with the air chamber so as to simplify the configuration of the air injection mechanism and the number of the air guiding passage. Moreover, the pressure and flux of the air injecting from the nozzle may be controlled via pressing on the valve rod. Therefore, the air injection mechanism integrated with the nail gun may make it lower in cost and facility in use.

The air injection mechanism of the present invention includes a gun body having a head cover at a top portion of the gun body, and an air chamber for guiding high pressure air into the gun body and maintaining a certain pressure in the gun body; a valve base disposed at a side surface of the gun body and adjacent to one end of the air chamber, which is integrated with the side surface or is fixed to the side surface via screws; a valve rod axially attached to a rod hole of the valve base and extend out of the gun body to form a press button for pushing the valve rod by pressing the button under outside force, another end of the valve rod extends through the air chamber and axially attached to another side surface of the gun body, the valve rod and the rod hole cooperate with each other to form an air guiding gap therebetween, the gap is connected to the air chamber, and the valve rod forms a ringed pushing surface enable to reposition via pushed by the high pressure air; an air guiding passage formed in the valve rod, which includes an air inlet port connecting to the air guiding gap and an air injection port connecting to environment; and at least one O-ring disposed at an inner surface of the rod hold that between the air guiding gap and the air inlet port for controlling the flux of the air that transmit from the air inlet port to the air injection port as well as the operation state of the air inlet port.

The air injection mechanism of the nail gun further includes an O-ring disposed between the valve rod and the gun body, and another O-ring disposed between the valve rod and the rod hole.

The press end includes a press button thereof, which includes a male thread for engaging with a screw cap for use in adjusting the moving distance of the valve rod, a plurality of axial bead grooves alternatively disposed adjacent to the male thread, and a spring bead enable to nest in or release from one of the bead grooves.

The gun body further includes a press plate for conveniently pressing or releasing the press end.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
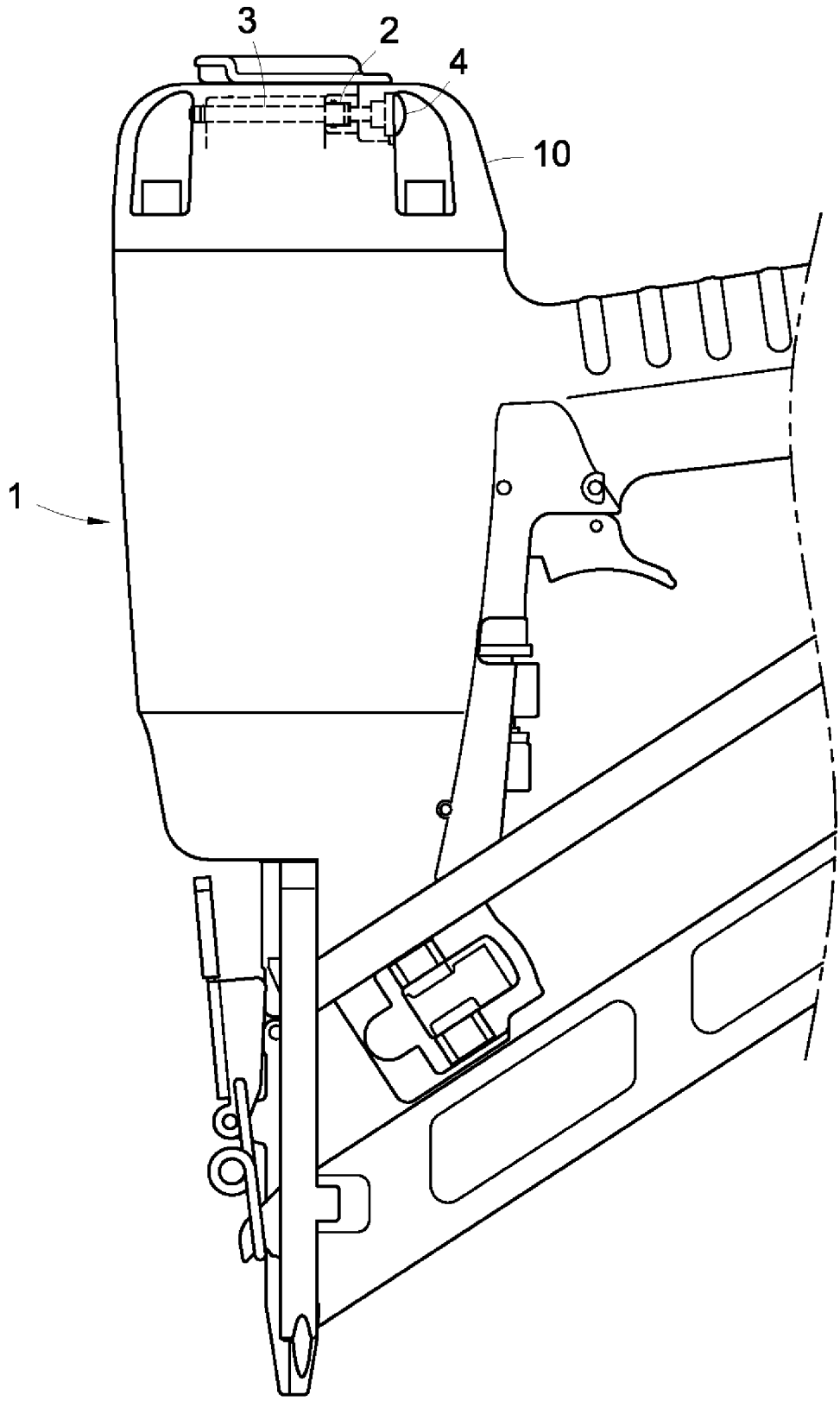
FIG. 1 is a schematic, abbreviate view of an air injection mechanism according to a first embodiment of the present invention, showing the air injection mechanism disposed in a head cover of a gun body of a pneumatic nail gun.
Figure 2:
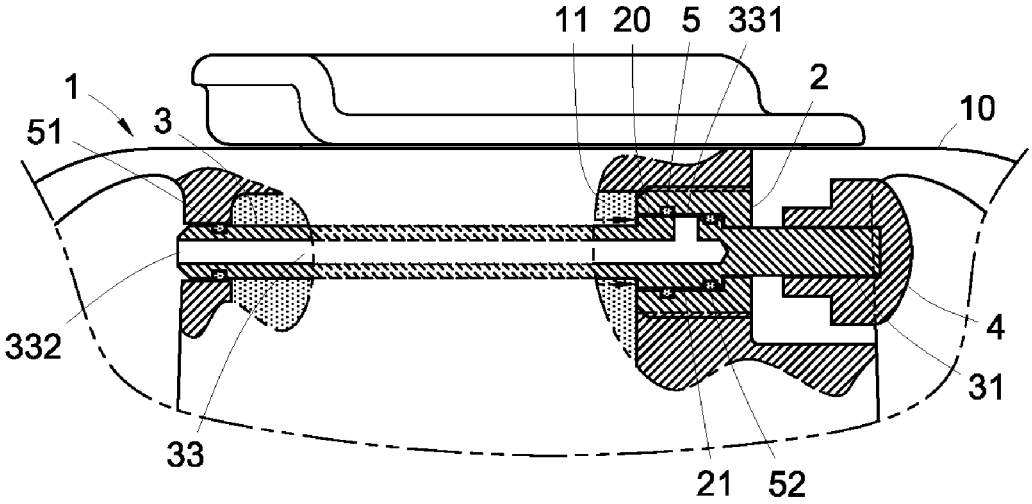
FIG. 2 is an enlarged, cross-sectional view of part of the gun body of FIG. 1, showing a valve base of the air injection mechanism engaging at an surface of the head cover adjacent to one end of an air chamber of the nail gun.

Referring to FIGS. 1-2, an air injection mechanism employed in a pneumatic nail gun includes a gun body 1, a valve base 2, a valve rod 3, an air guiding passage 33, and an O-ring 5.

The gun body 1 includes an compressed air chamber 11 for guiding high pressure air into the gun body and maintaining a certain high pressure therein, and a head cover 10 disposed at a top portion of the gun body.

Figure 3:
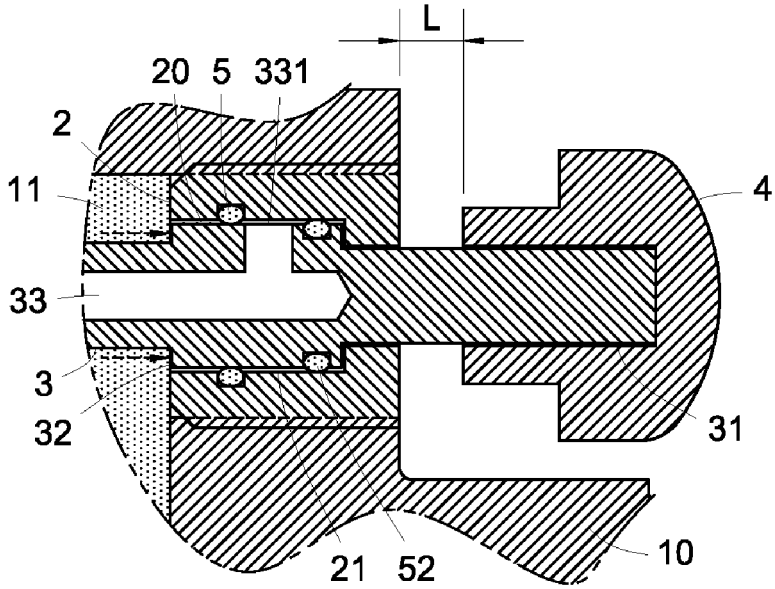
FIG. 3 is an enlarged, cross-sectional view of part of the FIG. 2, showing an air guiding passage of the air injection mechanism having an air inlet port connecting with an air guiding gap.
Figure 4:
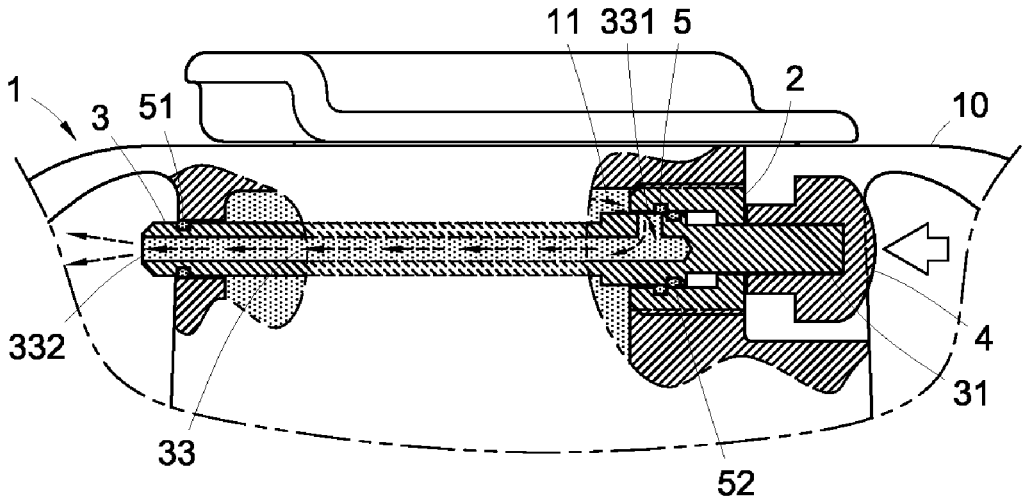
FIG. 4 is a schematic, cross-sectional view of an operation state of the air injection mechanism of FIG. 1, showing press end of a valve rod thereof moving toward the rod hole that is pushed by a press button.

The valve base 2 is disposed at a side surface of the head cover 10 of the gun body 1, and adjacent to one end of the air chamber 11, which is integrated with the side surface or is fixed to the side surface via screws. The valve base 2 includes a rod hole 21 (shown in FIGS. 2 and 3).

One end of the valve rod 3 is axially attached to the rod hole 21 of the valve base 2, and extends out of the gun body 1 to form a press end 31. A press button 4 is nested with the press end 31. The other end of the valve rod 3 extends through the air chamber 11 and axially attached to another side surface of the head cover 10 of the gun body 1. The valve rod 3 and the rod hole 21 cooperate with each other to form an air guiding gap 20 therebetween, and the air guiding gap 20 is connected to the air chamber 11. The valve rod 3 forms a ringed pushed surface 32. An O-ring 51 is disposed between the valve rod 3 and the side surface of the head cover 10, and another O-ring 52 is disposed between the valve rod 3 and the rod hole 21 for prevent the high pressure air in the air chamber 11 from discharging.

The air guiding passage 33 is formed in the valve rod 3, which includes an air inlet port 331 connecting to the air guiding gap 20 and an air injection port 332 connecting to environment.

The O-ring 5 is disposed at an inner surface of the rod hold 21 that between the air guiding gap 20 and the air inlet port 331 for blocking the high pressure air in the air chamber 11 from transmitting to the air inlet port 331 via the air guiding gap 20.

With these configurations, the air injection mechanism may be used. In operation, when the press button 4 is not pressed, the high pressure air in the air chamber 11 may push the ringed pushed surface 32 to press and fasten the valve rod 3 in the rod hole 21 of the valve base 2. The O-ring 5 blocks between the air guiding gap 20 and the air inlet port 331 so as to prevent the high pressure air in the air chamber 11 from transmitting into the air guiding passage 33. Therefore, there is no air discharging from the air injection port 332 at the other side of the head cover 10. On the other hand, when the press button 4 is pressed by the operator, the press end 31 induced by the press button may move along the rod hole 21, then the air inlet port 331 may move away from the O-ring 5 to guide the high pressure air in the air chamber 11 into the air inlet port 331 via the air guiding gap 20, and the high pressure air are transmitted to the air injection port 332 as well as are injected therefrom.

Figure 5:
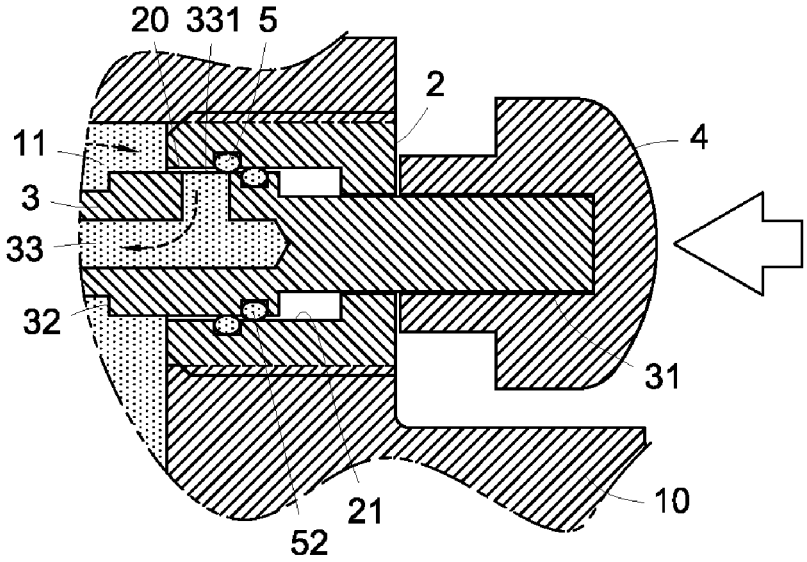
FIG. 5 is an enlarged, cross-sectional view of part of the FIG. 4, showing the air transmitting from the air chamber to the air inlet port via the air guiding gap.
Figure 6:
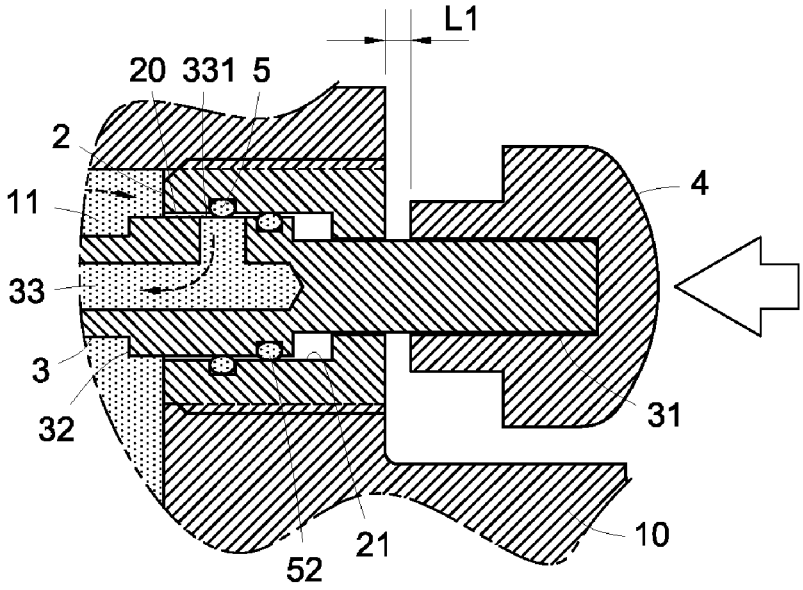
FIG. 6 is a schematic, cross-sectional view of another operation state of the air injection mechanism of FIG. 1, showing the open level between the air inlet port and the air guiding gap that are controlled by adjusting the level of the force pressed on the press button.

Moreover, a bottom portion of the press button 4 (shown in FIG. 3) has a distance L relative to the valve base 2, which is the moving distance of the valve rod 3. Operator may adjust the level (strength or weakness) of the force that pressed on the press button 4 to control the moving distance of the valve rod 3 so as to control the open level between the air inlet port 331 and the air guiding gap 20 for determining the strength of the discharged air of the air injection port 332. In other words, when the bottom portion of the press button 4 (shown in FIG. 5) abuts the valve base 2, the valve rod 3 has a moving distance L, the open level of the air inlet port is maximal, and the strength of the discharged air of the air injection port 332 are maximal. When the bottom portion of the press button has a distance L1 relative to the valve base 2, the open level of the air inlet port has a moving distance less than the moving distance L, the open level of the air inlet port is smaller, and the strength of the discharged air of the air injection port 332 is weaker.

Figure 7:
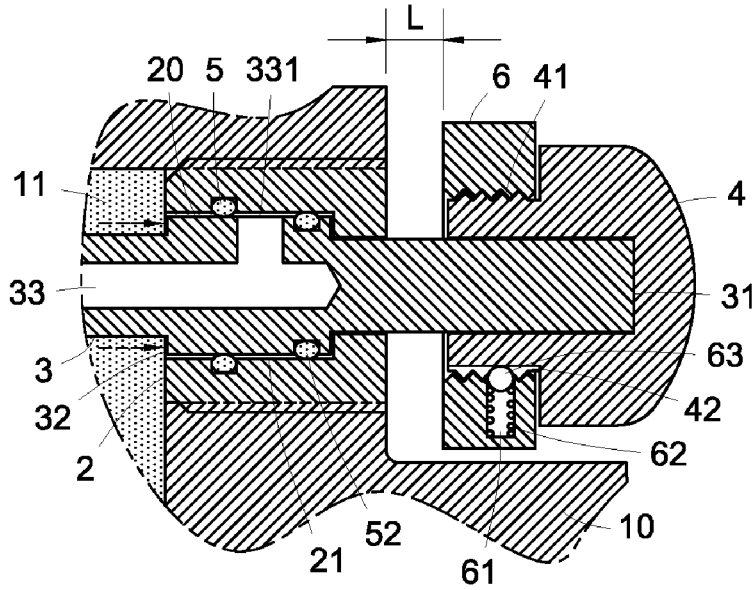
FIG. 7 is a schematic, enlarged view of an air injection mechanism according to a second embodiment of the present invention, showing a press button thereof having a male thread for engaging with a screw cap.
Figure 8:
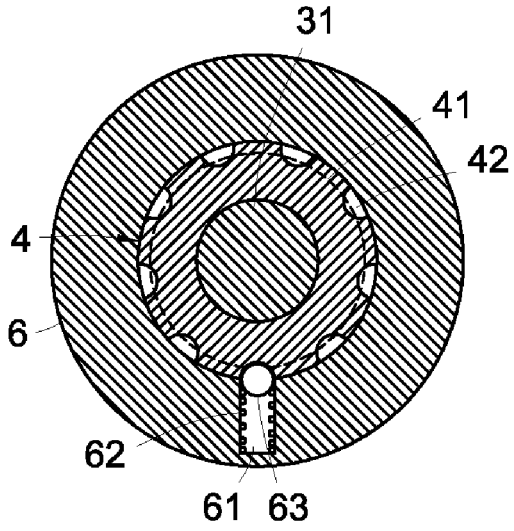
FIG. 8 is an enlarged, cross-sectional view of FIG. 7, showing the screw cap having a containing groove therein, the containing groove having a spring bead and a spring against the bead therein.
Figure 9:
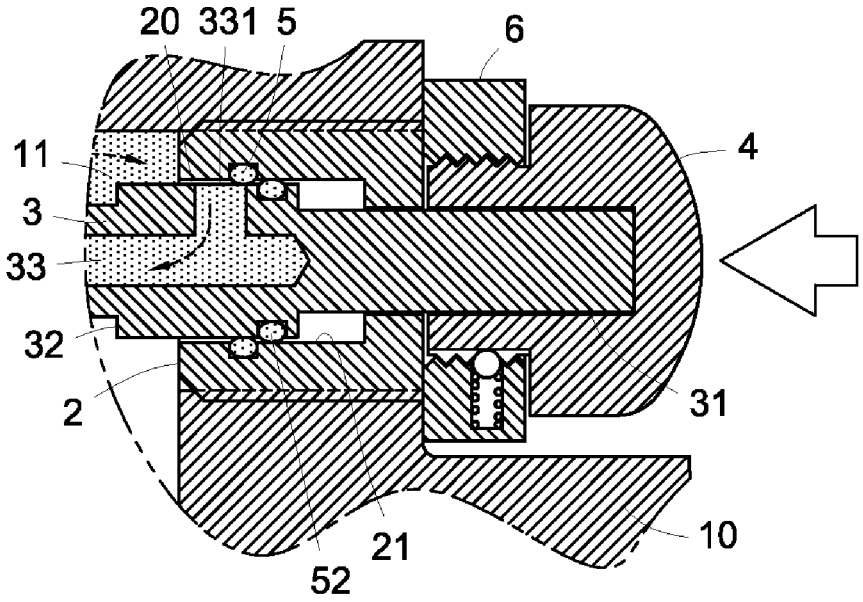
FIG. 9 is a schematic, cross-sectional view of an operation state of the air injection mechanism of FIG. 7, showing the screw cap fixing to the bottom of the press button to maximally open the air inlet port.
Figure 10:
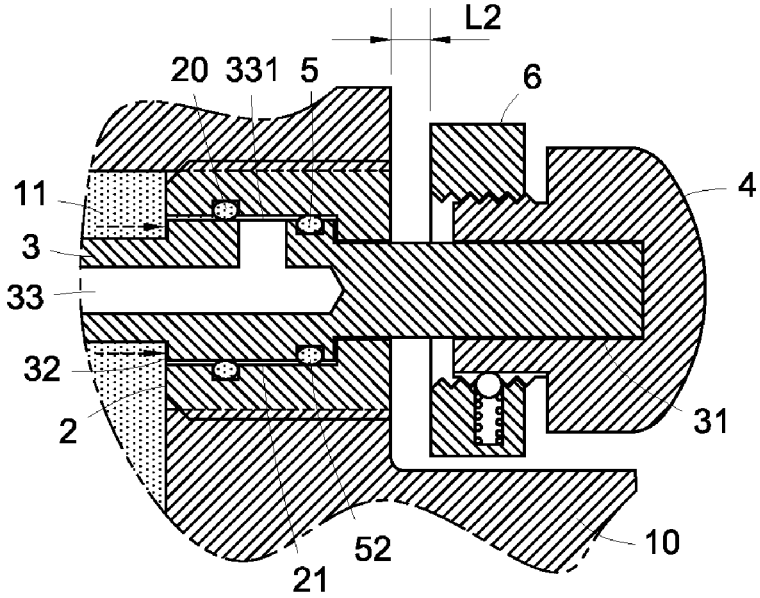
FIG. 10 is a schematic, cross-sectional view of another operation state of the air injection mechanism of FIG. 7, showing the screw cap being able to be adjusted to control the moving distant of the valve rod.
Figure 11:
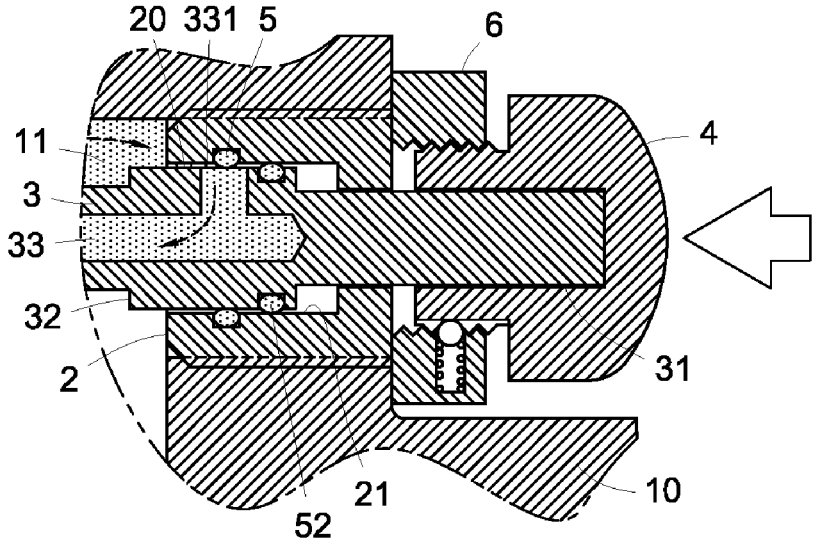
FIG. 11 is a schematic, cross-sectional view of further another operation state of the air injection mechanism of FIG. 7, showing the valve rod is moved to lightly open the air inlet port via operating the screw cap.

In addition, a bottom portion of the press button 4 (shown in FIG. 7) forms a male thread 41 thereof for engaging with a screw cap 6. The male thread 41 includes a plurality of axial bead grooves 42 (shown in FIG. 8) alternatively disposed thereon, and a containing groove 61 disposed in the screw cap 6. The containing groove 61 includes a spring 62 and a spring bead 63 therein, wherein the spring abuts the spring bead 63 so as to make the spring bead 63 to nest in or to release from one of the bead grooves 61 for freely rotating the screw cap 6 to appointed position. When the screw cap 6 is rotated to an appointed position, the spring bead 63 abutted by the spring 62 may against and fix the screw cap 6 thereat. With these configurations, when the screw cap 6 (shown in FIG. 7) rotates to the bottom portion of the press button 4, the screw cap 6 has a distance L relative to the valve base 2, which is the moving distance of the valve rod 3. Then the press button 4 (shown in FIG. 9) abuts the head cover 10 so as to make the air inlet port 331 has a greater open level. When the screw cap 6 (shown in FIG. 10) has a distance L2 relative to the valve base 2, that is, the moving distance of the valve rod 3 is shorten from L to L2. Then the press button 4 (shown in FIG. 11) abuts the head cover 10 so as to make the air inlet port 331 has a less open level. Accordingly, it may control the moving distance of the valve rod 3 via adjusting the screw cap 6 for rightly controlling the flux and strength of the high pressure air of the air injection port 332.

Figure 12:
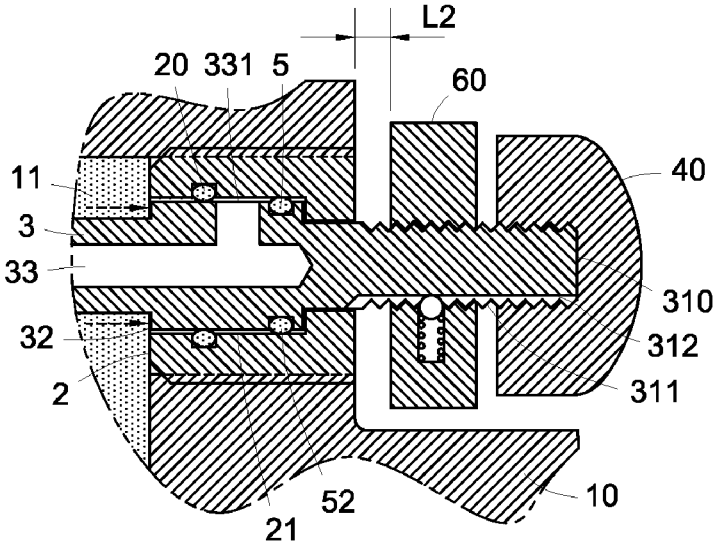
FIG. 12 is a schematic, enlarged view of an air injection mechanism according to a third embodiment of the present invention, showing the male thread formed at the press end of the valve rod for engaging with a screw cap.

Furthermore, the male thread 311 (shown in FIG. 12) may be formed at the press end 310 of the valve rod 3 for engaging a press button 40. The male thread 311 includes a plurality of axial bead grooves 312 (shown in FIG. 8) alternatively disposed thereon so as to make the screw cap 60 engage with the male thread 311 of the press end 310. The operation state is similar to that of the screw cap 6 described above.

Figure 13:
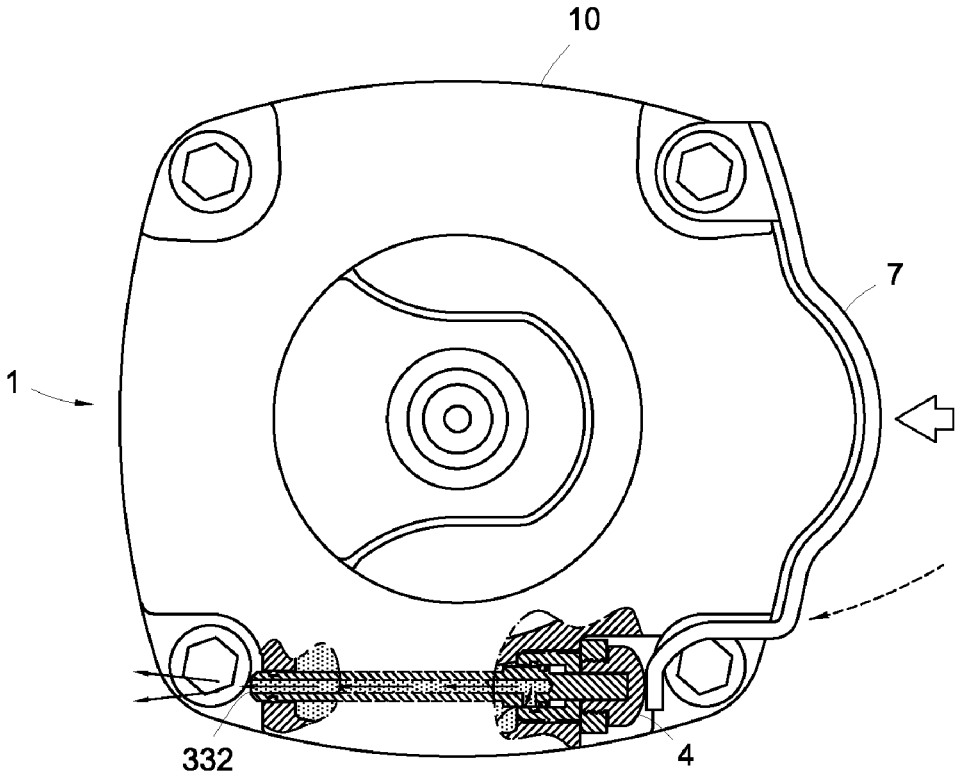
FIG. 13 is a schematic, top view of part of an air injection mechanism according to a fourth embodiment of the present invention, showing a press plate arranged on a head cover of a gun body of a nail gun, which is disposed adjacent to the press button of the air injection mechanism.

The air injection mechanism according to the present invention may further includes a press plate 7 engaging with the head cover 10 of the gun body 1 (shown in FIG. 13), which may has a figure similar to that of the head cover 10. One end of the press plate 7 is adjacent to the press button 4. The operator may rapidly press or release the press button 4 via push or release the press plate 7 so as to conveniently control the injection of the high pressure air.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An air injection mechanism for pneumatic nail gun comprising:

a gun body having an air chamber accumulating a compressed high pressure air with a constant pressure;

a valve base disposed at a side surface of the gun body and adjacent to one end of the air chamber, the valve base being integrated with the side surface or fixed to the side surface via screws, the valve base having a rod hole;

a movable valve rod, one end of the valve rod engaging with the rod hole and extending out of the gun body to form a press end, and another end of the valve rod extending through the air chamber and fixing to another side surface of the gun body, the valve rod and the rod hole cooperating with each other to form an air guiding gap therebetween, the valve rod comprising a ringed pushing surface being able to reposition via being pushed by the high pressure air, the press end having a male thread thereat engaged with a screw cap that adjusts the moving distance of the valve rod;

an air guiding passage formed in the valve rod, the air guiding passage comprising an air inlet port connecting to the air guiding gap and an air injection port connecting to environment; and at least one O-ring disposed at an inner surface of the rod hole that between the air guiding gap and the air inlet port for controlling the flux of the high pressure air that transmit from the air inlet port to the air injection port as well as the operation state of the air inlet port.

2. The air injection mechanism as claimed in claim 1, wherein the air chamber is formed in a head cover of the gun body.

3. The air injection mechanism as claimed in claim 1, wherein the male thread comprises a plurality of axial bead grooves alternatively disposed thereat, the screw cap comprises a spring bead being able to nest or release from one of the bead grooves.

4. The air injection mechanism as claimed in claim 1, wherein the gun body further comprises a press plate for conveniently pressing or releasing the press end.

5. An air injection mechanism for pneumatic nail gun comprising:

a gun body having an air chamber accumulating a compressed high pressure air with a constant pressure;

a valve base disposed at a side surface of the gun body and adjacent to one end of the air chamber, the valve base being integrated with the side surface or fixed to the side surface via screws, the valve base having a rod hole;

a movable valve rod, one end of the valve rod engaging with the rod hole and extending out of the gun body to form a press end, and another end of the valve rod extending through the air chamber and fixing to another side surface of the gun body, the valve rod and the rod hole cooperating with each other to form an air guiding gap therebetween, the valve rod comprising a ringed pushing surface being able to reposition via being pushed by the high pressure air;

an air guiding passage formed in the valve rod, the air guiding passage comprising an air inlet port connecting to the air guiding gap and an air injection port connecting to environment; and at least one O-ring disposed at an inner surface of the rod hold that between the air guiding gap and the air inlet port for controlling the flux of the high pressure air that transmit from the air inlet port to the air injection port as well as the operation state of the air inlet port, wherein the gun body further comprises a press plate for conveniently pressing or releasing the press end.

* * * * *